US008985633B2

(12) United States Patent
Bodziak

(10) Patent No.: US 8,985,633 B2
(45) Date of Patent: Mar. 24, 2015

(54) FOLDABLE POP-UP ARTICLE

(75) Inventor: Douglas P. Bodziak, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 402 days.

(21) Appl. No.: 13/545,121

(22) Filed: Jul. 10, 2012

(65) Prior Publication Data

US 2014/0014554 A1 Jan. 16, 2014

(51) Int. Cl.

| | |
|---|---|
| ***B42D 1/00*** | (2006.01) |
| ***A45C 11/18*** | (2006.01) |
| ***A45C 13/00*** | (2006.01) |
| ***A45C 13/02*** | (2006.01) |
| ***B42D 15/00*** | (2006.01) |
| ***B42F 7/00*** | (2006.01) |
| *A45C 1/06* | (2006.01) |
| *A45C 1/08* | (2006.01) |

(52) U.S. Cl.

CPC ..... *A45C 11/18* (2013.01); *A45C 13/005* (2013.01); *A45C 13/02* (2013.01); *B42D 15/00* (2013.01); *B42F 7/00* (2013.01); *A45C 2001/065* (2013.01); *A45C 2001/083* (2013.01)

USPC ..... 281/21.1; 281/42; 281/45; 402/58; 402/79

(58) Field of Classification Search

CPC ..... A45C 11/18; A45C 13/005

USPC ..... 206/37–39, 45.28, 425, 449, 525.1, 206/767, 768, 784; 281/2, 21.1, 27.1, 42, 281/44, 45, 47, 49, 51, 27.3; 402/57, 58, 402/70, 72, 79

See application file for complete search history.

(56) References Cited

U.S. PATENT DOCUMENTS

| | | | | |
|---|---|---|---|---|
| 2,831,279 | A * | 4/1958 | Esslinger, Jr. | 402/57 |
| 4,787,653 | A * | 11/1988 | Stewart, Jr. | 281/2 |
| 4,861,073 | A * | 8/1989 | Poretsky | 281/45 |
| 5,295,089 | A * | 3/1994 | Ambasz | 361/679.09 |
| 5,332,265 | A * | 7/1994 | Groess et al. | 283/56 |
| 5,375,885 | A * | 12/1994 | Abercrombie | 281/42 |
| 5,407,231 | A | 4/1995 | Schwartz | |
| 5,868,429 | A * | 2/1999 | Raymond et al. | 283/34 |
| 6,629,800 | B1 * | 10/2003 | Brown | 402/58 |
| 6,641,171 | B2 * | 11/2003 | Lin et al. | 281/33 |
| 6,702,330 | B2 | 3/2004 | Roca | |
| 7,726,695 | B2 | 6/2010 | Howes | |
| 2003/0168468 | A1 | 9/2003 | Thompson | |
| 2005/0258060 | A1 | 11/2005 | Katz | |
| 2008/0073897 | A1 | 3/2008 | Vincent | |
| 2010/0300909 | A1 * | 12/2010 | Hung | 206/320 |
| 2011/0101668 | A1 | 5/2011 | Pyeon | |

OTHER PUBLICATIONS

International Search Report, PCT/US2013/045310, mailed Oct. 16, 2013, 3 pages.

3M Post-lt Hard Cover Book product description, [product description retrieved from the Internet on Jul. 5, 2012, with the product believed to have been sold in the US at least one year prior to that date)]; URL <http ://shopping.yahoo.com/886368716-post-it-4-x-6-flower-burst-hard-cover-book/>; 1 page.

* cited by examiner

*Primary Examiner* — Luan K Bui

(74) *Attorney, Agent, or Firm* — Kenneth B. Wood

(57) ABSTRACT

A foldable and unfoldable pop-up article with a tensioning member.

20 Claims, 6 Drawing Sheets

FOLDABLE POP-UP ARTICLE

BACKGROUND

Dispensers for presenting notepads from which individual sheets of notepaper can be removed, dispensers for items such as business cards, page-marking flags, display devices for various purposes, and so on, are commonly used e.g. in home and office environments around the world.

SUMMARY

In broad summary, herein is disclosed a foldable and unfoldable pop-up article comprising a tensioning member. These and other aspects of the invention will be apparent from the detailed description below. In no event, however, should the above summary be construed to limit the claimable subject matter, whether such subject matter is presented in claims in the application as initially filed or in claims that are amended or otherwise presented in prosecution.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted. As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, strictly, and the like, as applied to a quantifiable property or attribute, mean within +/−5%, unless otherwise specifically defined.

DETAILED DESCRIPTION

Disclosed in various embodiments herein is a foldable and unfoldable pop-up article, as illustrated in various exemplary embodiments in FIGS. 1-7. For convenience of description, certain features and properties of such articles will be described with reference to the article when in a first, open position (even though the article may not necessarily be supplied to a user in this position, as will be evident herein), as shown in FIGS. 1, 4, 6 and 7. For convenience of description, side 40 from which an article (e.g., 1 or 101) is viewed in these Figures will be referred to as the front side of the article, comprising major front surface 41, with the opposite side 44 of the article being referred to as the rear side, comprising major rear surface 45.

Figure 1:
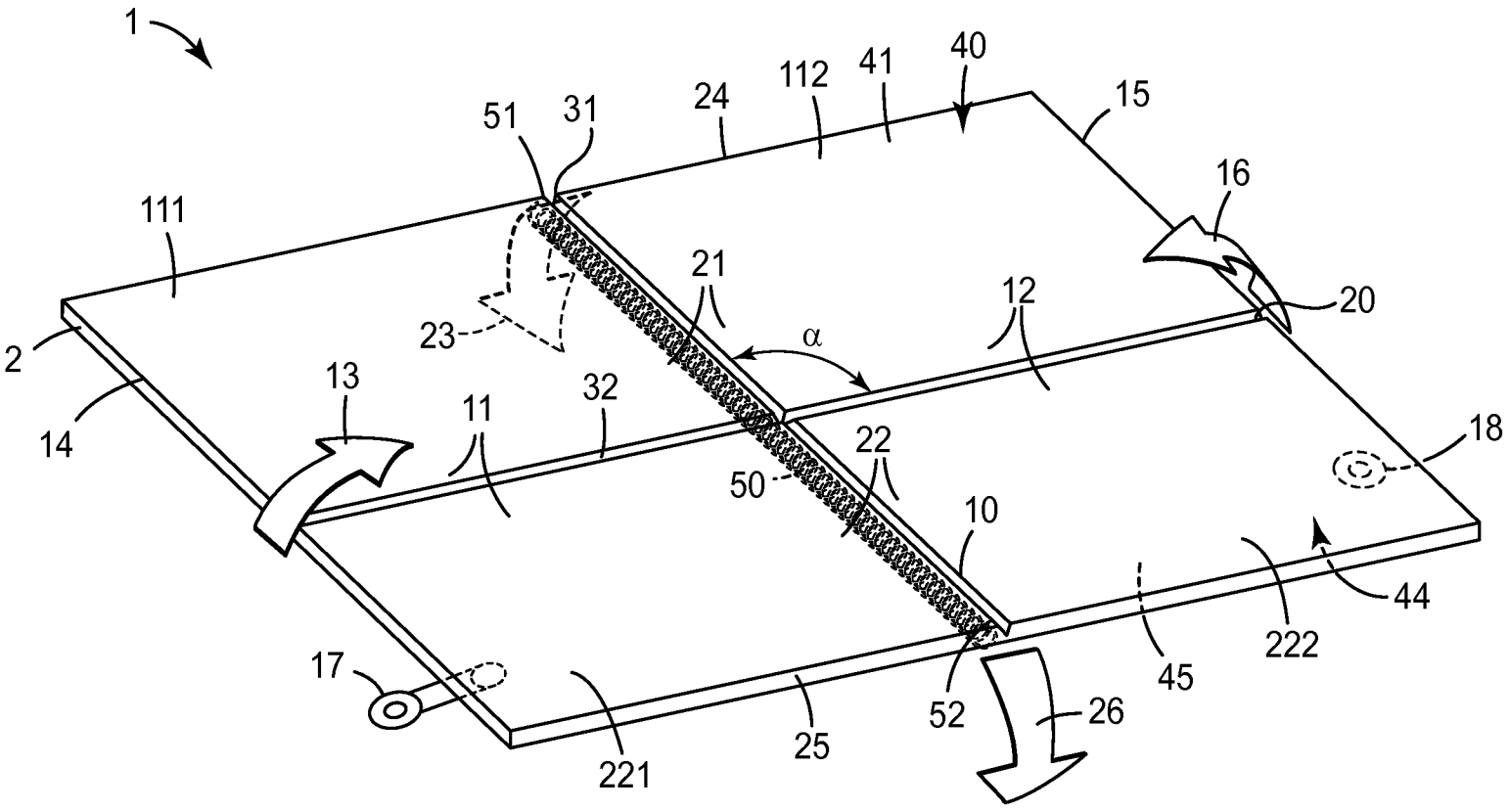
FIG. 1 is a perspective view, from the front side, of an exemplary foldable pop-up article in a first, open position.

A foldable and unfoldable pop-up article as disclosed herein comprises a primary folding axis 10, and at least one secondary folding axis 20, which is oriented at an angle (e.g., an included angle alpha ($\alpha$) as shown in FIG. 1) that is at least about 30 degrees away from primary folding axis 10. In further embodiments, the angle between a secondary folding axis 20 and a primary folding axis 10 may be at least about 50 or 70 degrees. In particular embodiments, a secondary folding axis 20 may be oriented within plus or minus 10, 5, or 2 degrees of orthogonal (perpendicular) to primary folding axis 10, noting that an orthogonal relationship (i.e., with an angle $\alpha$ of approximately 90 degrees) is shown in FIG. 1. In some embodiments, only a single secondary folding axis 20 may be present (as in FIG. 1).

Here and elsewhere herein, for convenience of description, the dimension of a foldable and unfoldable pop-up article that is at least generally orthogonal to primary folding axis 10 (which dimension, in some embodiments, may be at least generally parallel to a secondary folding axis 20) will be referred to as the length of the article, and the dimension of the article that is generally parallel to axis 10 will be referred to as the width of the article. It will be appreciated, however, that these designations are arbitrary and that the length and width of such an article could be similar or identical; or, in some cases, the width dimension could be longer than the length dimension. Yet again for convenience of description, certain portions, edges, etc. of such an article that are oriented at least generally parallel to folding axis 10 will be referred to as vertical portions, edges, etc., and such portions, edges etc. that are oriented at least generally orthogonal to folding axis 10 will be referred to as horizontal portions, edges, etc. It is emphasized that such terms are used in their relative sense, for the purpose of describing the arrangement of, and relationship between, various components of such articles, and do not signify any specific relationship to a vertical or horizontal axis as defined by the Earth's gravity except where specifically noted.

In the illustrated embodiment of FIG. 1, article 1 comprises a backing 2 as described herein, and comprises primary folding axis 10 that extends the width of backing 2, from first major horizontal edge 24 of backing 2 to second major horizontal edge 25 of backing 2. Conveniently, primary folding axis 10 may be provided by way of one or more hinged connections 31 in backing 2 (noting that such a hinged connection does not necessarily have to extend the width of backing 2 to provide a folding axis that extends the width of backing 2). By a folding axis is meant an axis about which two portions of backing 2 of article 1, which portions are hingedly connected generally along at least portions of the axis, can be rotated relative to each other. Thus, folding axis 10 and hinged connection 31 thereof may divide backing 2 e.g. into first and second major vertical portions 11 and 12 that are rotatable relative to each other about primary folding axis 10.

In the illustrated embodiment of FIG. 1, article 1 further comprises secondary folding axis 20 that is orthogonal to primary folding axis 10 and that extends the length of backing 2, from first major vertical edge 14 to second major vertical edge 15 (noting that such a hinged connection does not necessarily have to extend the length of backing 2 to provide a folding axis that extends the length of backing 2). Secondary folding axis 20 may be provided by way of one or more hinged connections 32 in backing 2, and may divide backing 2 e.g. into first and second major horizontal portions 21 and 22 that are rotatable relative to each other about secondary folding axis 20. Folding axes 10 and 20 may thus collectively divide backing 2 into four major quadrants, designated in FIG. 1 as quadrants 111, 112, 221, and 222. Quadrants 111 and 112 collectively provide first major horizontal portion 21; quadrants 111 and 221 collectively provide first major vertical portion 11, quadrants 221 and 222 collectively provide second major horizontal portion 22, and quadrants 112 and 222 collectively provide second major vertical portion 12. While in the exemplary embodiment of FIG. 1, all of these quadrants are depicted as approximately equal in size, this does not necessarily have to be true in all embodiments. Likewise, first and second major vertical portions 11 and 12 may be, but do not have to be, generally, substantially, or strictly equal to each other in size. Likewise, first and second major horizontal portions 21 and 22 may, but do not have to be, generally, substantially, or strictly equal to each other in size.

Backing 2 of such an article may be made of any suitable material, e.g. paperboard, plastic, etc. Often, backing 2 may be made of paperboard, e.g. in a thickness range of about 0.3 mm to about 5 mm. In some embodiments, backing 2 may be made of a rigid material. By this it is not meant that backing 2 must be absolutely unbendable; rather, it is meant that backing 2 is made of a material that is sufficiently stiff that portions of backing 2 will not be significantly rotated relative to each other during ordinary use (i.e., while being manipulated by hand by a user), except as provided by the herein-described hinged connections. Thus, to take a specific example, if backing 2 is made of a rigid material, quadrant 111 and quadrant 112 of first major horizontal portion 21 will each remain in a generally planar (flat) configuration, even as the quadrants may be rotated relative to each other about folding axis 10/hinged connection 31. Such a level of stiffness/rigidity may be achieved e.g. by making backing 2 of paperboard of thickness at least about 1 mm. In further embodiments, backing 2 may be made of paperboard of thickness at least about 2 mm.

Hinged connections may be provided in backing 2 in any suitable manner. For example, backing 2 may comprise a molded polymeric sheet (e.g., a rigid sheet) having various portions with living hinges provided (e.g. as formed during molding of the sheet) therebetween so as to hingedly connect the various portions. Or, backing 2 may comprise portions of sheet material that are hingedly connected by way of flexible films (e.g., adhesive tapes) that hingedly connect the various portions. Or, backing 2 may comprise portions of sheet material that are hingedly connected by spiral-bound connections (akin to that found in spiral notebooks). In some embodiments, such hinged connections may be provided by scoring a sheet material so as to provide score lines between portions of the material. Such scoring, particularly when backing 2 is comprised of paperboard, may comprise e.g. crush scoring, partial cutting, etc., in any suitable manner that can provide a score line that penetrates partially through the thickness of backing 2. (Such a score line may penetrate into backing 2 from only one side, as shown in FIG. 1; or, it may penetrate into backing 2 from the other side, e.g. to enable a higher amount of rotation relative thereto). Any combination of the above-listed connections may be used. Thus in general, a hinged connection as described herein may be provided by any suitable method of forming or otherwise providing a line of weakness in backing 2, that permits portions, e.g. major portions, of backing 2 that are connected through the line of weakness to be rotated relative to each other, including such methods are a commonly used in the assembly of books, binders, folders, and the like. Regardless of the specific type and design of the hinged connections, they should be configured so that at any intersection (crossing point) of e.g. a hinged connection of a primary folding axis and a hinged connection of a secondary folding axis, a hinged connection of a first secondary folding axis and a hinged connection of a second secondary folding axis (as discussed later herein), and so on, the presence of a former hinged connection should not unduly interfere with the ability to fold the backing about the latter hinged connection, and vice versa.

A foldable and unfoldable pop-up article as disclosed herein comprises at least one tensioning member 50 that is provided on the rear side of backing 2. Tensioning member 50 comprises an elongated length with a long axis that is oriented at least 30 degrees away from the above-mentioned at least one secondary folding axis 20. (Such an orientation may be most easily ascertained when the article is in the first, open position). In further embodiments, the long axis of member 50 may be oriented at least 50 or 70 degrees away from the at least one secondary folding axis 20. In particular embodiments, such an axis of member 50 may be oriented within plus or minus 10, 5, or 2 degrees of orthogonal (perpendicular) to a secondary folding axis 20, noting that an orthogonal relationship (i.e., with an angle $\alpha$ of approximately 90 degrees) is shown in FIG. 1.

In some embodiments, the long axis of tensioning member 50 may be oriented within 45 degrees of primary folding axis 10 of article 1. In further embodiments, the long axis of tensioning member 50 may be oriented within 10, or 5 degrees of primary folding axis 10. In some cases, tensioning member 50 may be strictly parallel to (i.e., within about two degrees of) primary folding axis 10. It is noted that such a parallel orientation does not necessarily require that tensioning member 50 be aligned with primary folding axis 10 (i.e., rather than being displaced or offset from folding axis 10 along the length dimension of article 1). However, in some embodiments tensioning member 50 may be generally, substantially, or strictly aligned with primary folding axis 10 (with an at least substantially parallel and aligned relationship of tensioning member 50 and primary folding axis 10 being depicted in FIG. 1). In other embodiments, one or more tensioning members may be provided that are displaced (along the length dimension of article 1) away from primary folding axis 10, so that such a tensioning member or members, while being at least generally parallel to primary folding axis 10, are not aligned therewith.

In the disclosed article, tensioning member 50 is tensionably engaged with backing 2 at least at two spaced-apart locations (e.g., locations 51 and 52 as shown in FIG. 1), with an axis connecting the locations to each other being oriented at least 30 degrees away from at least one secondary folding axis 20. (It will be appreciated that an axis connecting engagement locations 51 and 52 will often be aligned with the long axis of tensioning member 50.) In further embodiments, such an axis may be oriented at least 50, 60, or 70 degrees away from at least one secondary folding axis 20. In particular embodiments, such an axis may be oriented within plus or minus 10, 5, or 2 degrees of orthogonal (perpendicular) to a secondary folding axis 20. Engagement locations 51 and 52 may advantageously be, but do not necessarily have to be, respectively located proximal to (e.g., with 1 cm of) first and second horizontal edges 24 and 25 of backing 2. All that is necessary is that at locations 51 and 52, tensioning member 50 is configured to engage with (e.g., contact) backing 2 in order to satisfactorily apply tension to backing 2 to promote the folding of backing 2 into a popped-up position as explained in detail herein. With article 1 in a first, open position, tensioning member 50 will thus be in a tensioned (e.g., stretched) condition so as to apply a pulling force to backing 2 at locations 51 and 52, which pulling force will motivate these locations of backing 2 to be brought closer together toward each other and will promote the folding of article 1 into a popped-up position as discussed herein.

Figure 2:
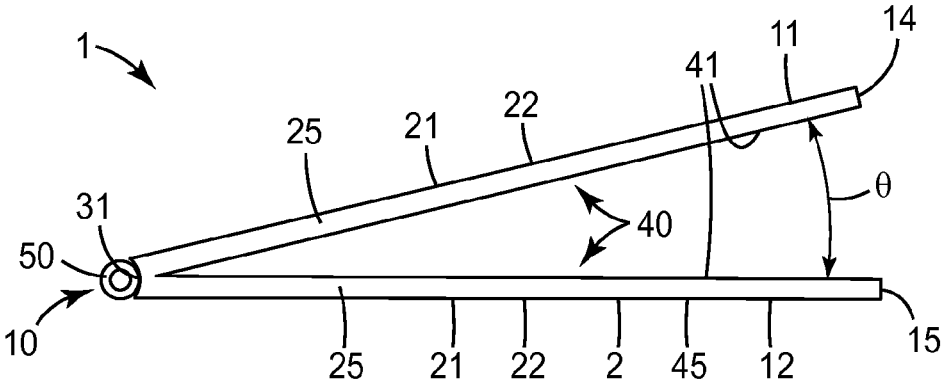
FIG. 2 is a side elevation view of the exemplary article of FIG. 1, in a second, generally closed position.

With the above components and relationships described, the functioning of exemplary article 1, and of such articles in general, may now be discussed. When article 1 is the in the first, open position as shown in FIG. 1, all portions of backing 2 may be at least generally co-planar with each other (with a strictly co-planar relationship being shown in FIG. 1). Article 1 may be folded from this first, open position, into a second, generally closed position, by rotating first and second major vertical portions 11 and 12 relative to each other about primary folding axis 10. First vertical portion 11 may be moved as illustrated by arrow 13; second vertical portion 12 may be moved as illustrated by arrow 16; or some combination of both may occur. An exemplary generally closed position is depicted in FIG. 2 (which is a side elevation view looking along a direction aligned with folding axis 10 of FIG. 1). In such a generally closed position, first and second major vertical portions 11 and 12 form an included angle to each other (angle theta (θ) as shown in FIG. 2) that is from about 130 degrees to about 0 degrees (the vertex of such an included angle may often, but does not necessarily have to, fall at or near folding axis 10). This can be contrasted to the first, open position, in which portions 11 and 12 are substantially parallel to each other so that such an "included angle" theta will be in the range of 180 degrees. In further embodiments, the second position may be a substantially closed position, in which the included angle theta between first and second major vertical portions 11 and 12 is from about 20 to about 0 degrees. (The included angle of FIG. 2 appears to be less than 20 degrees, so that strictly speaking this particular generally closed position is a substantially closed position).

In summary, the closing of article 1 from a first, open position to a second, generally or substantially closed position, can be likened to the closing of an open book (with folding axis 10 generally corresponding to the spine of the book). It will be appreciated that tensioning member 50, being e.g. at least generally aligned with primary folding axis 10 about which the rotational movement of first and second vertical portions 11 and 12 relative to each other takes place, often may not affect (that is, may neither impede nor promote) the closing of article 1 from an open position to a closed position nor the opening of article 1 from a closed position to an open position. It will also be appreciated that the closing of article 1 in this manner may cause an area of major front surface 41 that is on first major vertical portion 11 of article 1 to be brought into an at least generally facing relationship with an area of major front surface 41 that is on second major vertical portion 12 of article 1. By a generally facing relationship is meant that an axis extended normal to an area of front surface 41 of first major vertical portion 11 (in a direction that does not pass through backing 2 within portion 11) will eventually contact second major vertical portion 12, and vice versa.

Figure 3:
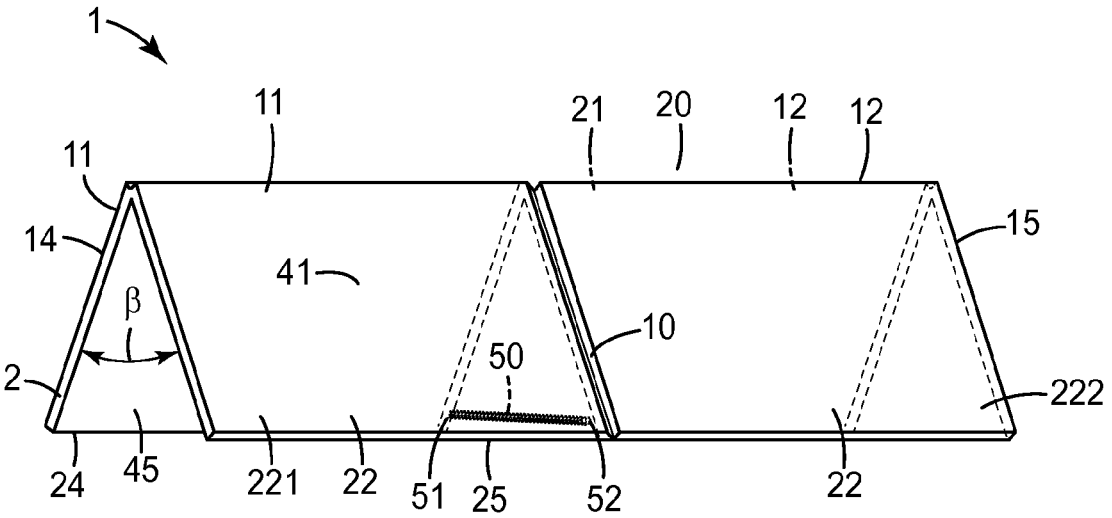
FIG. 3 is a perspective view of the exemplary article of FIG. 1, in a third, popped-up position.

An article as disclosed herein may be folded from the first, open position, into a third, popped-up position. In articles of the general type exemplified in FIGS. 1-3, this may be done by rotating first and second major horizontal portions 21 and 22 relative to each other about secondary folding axis 20. First horizontal portion 21 may be moved as illustrated by arrow 23; second horizontal portion 22 may be moved as illustrated by arrow 26; or some combination of both may occur. An exemplary popped-up position is depicted in FIG. 3 (which is a perspective view from a similar vantage point as FIG. 1). In such a popped-up position (in which article 1 may form a shape resembling an A-frame tent with secondary folding axis 20 comprising the apex of the A-frame) first and second major horizontal portions 21 and 22 form an included angle to each other (angle beta (β) as shown in FIG. 3) that is from about 130 degrees to about 30 degrees (the vertex of such an included angle may often, but does not necessarily have to, fall at or near folding axis 20). This can be contrasted to the first, open position, in which such an "included angle" beta will be in the range of 180 degrees. In further embodiments, first and second major horizontal portions may form an included angle of from about 70 degrees to about 110 degrees, which may optimally enhance the stability of article 1 when resting on a gravitationally-horizontal surface in the third, popped-up position, as discussed later herein.

It will be appreciated that the folding of article 1 in this manner may cause an area of major rear surface 45 that is on first major horizontal portion 21 of article 1 to be brought into an at least generally facing relationship with an area of major rear surface 45 that is on second major horizontal portion 22 of article 1. By a generally facing relationship is meant that an axis extended normal to an area of rear surface 45 of first major horizontal portion 21 (in a direction that does not pass through backing 2 within portion 21) will eventually contact second major horizontal portion 12, and vice versa.

It will be appreciated that the above-discussed tensioning force that is applied to backing 2 by tensioning member 50 will promote the folding of the article from the first, closed position, into the third, popped-up position and/or the maintaining of the article in the third, popped-up position. (When article 1 is in the third, popped-up position, tensioning member 50 will typically be shorter, and under less tension, than when article 1 is in the first position, as can be seen from comparing tensioning member 50 as it appears in FIGS. 1 and 3). In some embodiments, tensioning member 50 may merely provide a slight assist to the act of manually (i.e., by hand by a user) folding the article from the first, open position to the third, popped up position. In such case, the main function of tensioning member 50 may be to maintain the article in its popped-up position. In other embodiments, tensioning member 50 may exert sufficient tensioning force on backing 2 to bias the article toward the third, popped-up position so that when the article is in the first, open position, the article will spontaneously (that is, without assistance from a user) fold into the third, popped-up position unless an outside force (e.g., applied by the user) is exerted on the article to prevent it from folding into the third, popped-up position. In some embodiments, the article may comprise one or more protrusions that extend rearwardly (away from backing 2) from rear surface 45 of backing 2 at a location at or near folding axis 20. Such a protrusion may extend e.g. a few mm, so that when the article is placed into the first, open position on a horizontal surface, the protrusion may cause gravitational force to slightly fold the article toward the third, popped-up position (e.g., rather than being strictly planar), which may make it easier for the article to be urged into the third, popped-up position by the tensioning force of member 50.

It will be appreciated that when such an article is in the third, popped-up position, it may be able to rest on a gravitationally-horizontal surface 27 (i.e., a surface that is horizontal with respect to the Earth's gravity), with first and second major horizontal edges 24 and 25 of backing 2 being in contact with surface 27, as depicted in FIG. 3. In such a case, tensioning member 50 may be tensioned sufficiently to prevent the article from collapsing (unfolding) from the third, popped-up position, into the first, open position, under the force of the Earth's gravity.

With the above features and functionalities having been reviewed, the use of such articles can be discussed in general. Such an article may be supplied to a user, e.g. with the article in a second, generally or substantially closed condition (e.g., in "book" form). The user may e.g. transport or store the article in that position. During this time, backing 2 may serve to protect any contents of the article that may be present on first (front) major side 40 of the article. At a desired time, a user can unfold the article from the second position, into the above-described first (open) position. The article can then be folded from the first position into the third, popped-up position (which process might be spontaneously performed by the article without outside help, or may be facilitated by the user). This will cause the contents of first major (front) side 40 of the article to be presented. When desired, the article can be unfolded from the third, popped-up position (by manually overcoming the tensioning force exerted by tensioning member 50) into the first, open position, and can then be folded into the second, closed position as desired.

Figure 4:
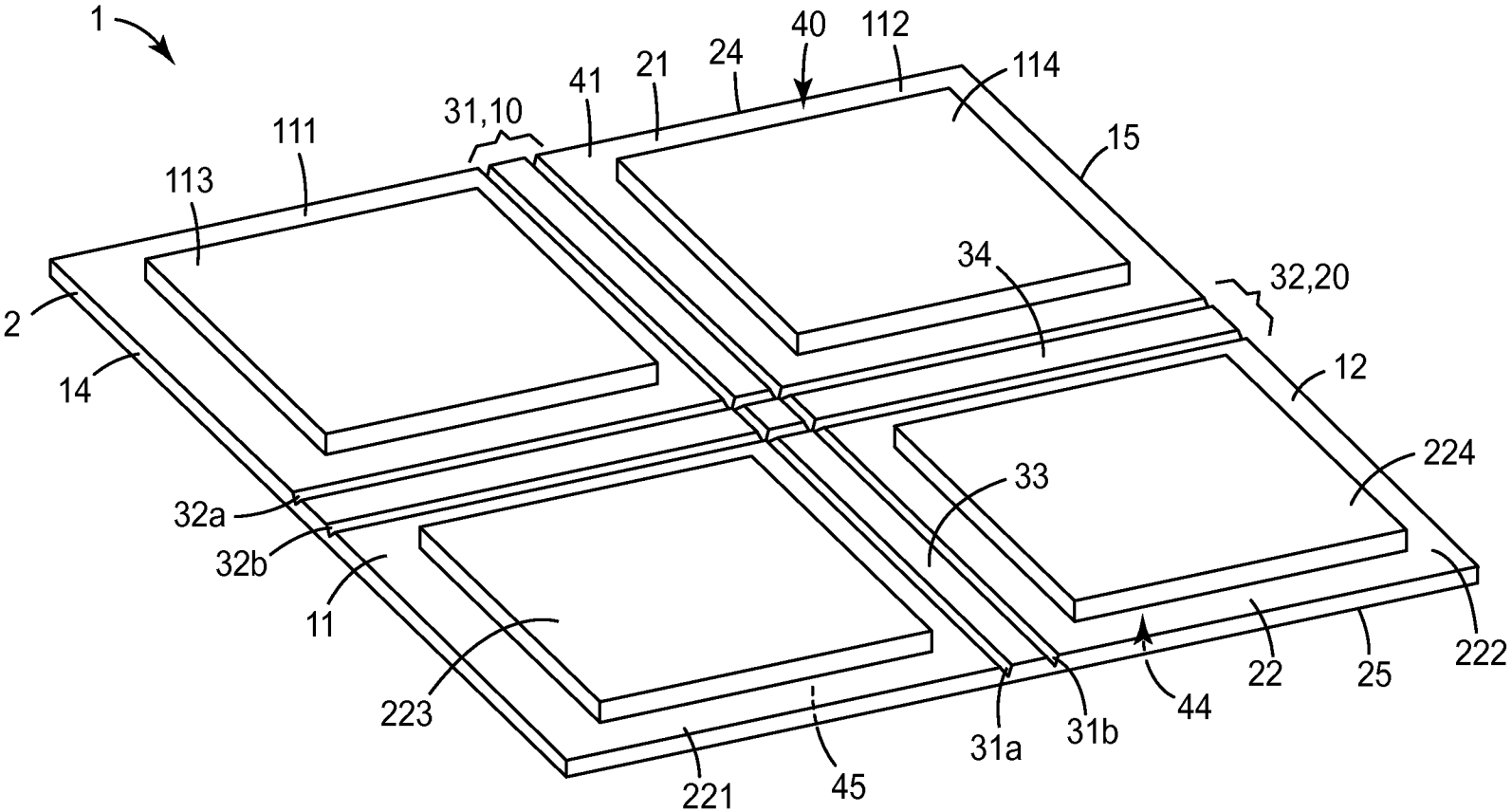
FIG. 4 is a perspective view, from the front side, of another exemplary foldable pop-up article in a first, open position.
Figure 5:
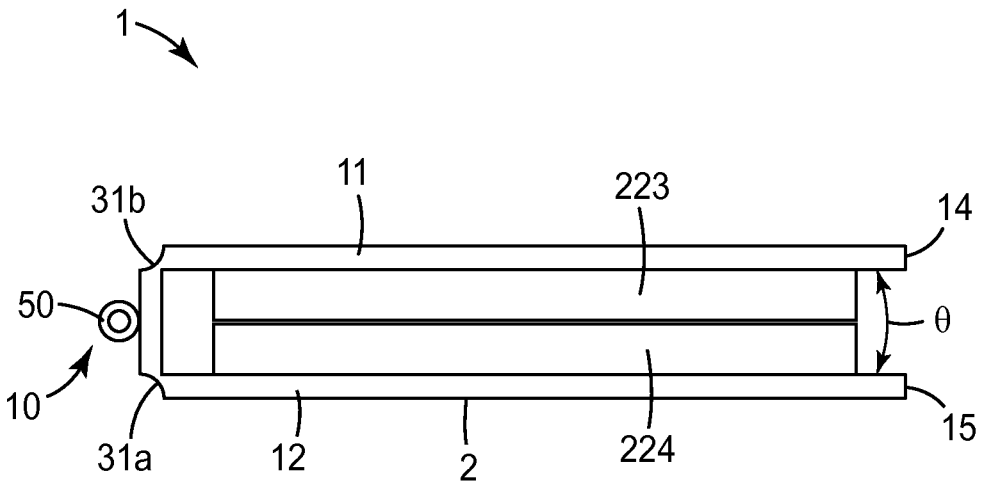
FIG. 5 is a side elevation view of the exemplary article of FIG. 4, in a second, substantially closed position.

Additional features and functions of such articles will now be described with reference to FIGS. 4 and 5. In FIG. 4 is depicted another exemplary article 1 in a first, open position, which article 1 is generally similar in design and function to that shown in FIGS. 1-3, but with certain features and functions that may be advantageous in some circumstances (in FIG. 4, tensioning member 50 is omitted for ease of presentation).

In the illustrated embodiment of FIG. 4, first, second, third and fourth notepads 113, 114, 223, and 224 are provided respectively in first, second, third and fourth quadrants 111, 112, 221, and 222 of article 1. Primary and secondary folding axes 10 and 20, and hinged connections thereof, are arranged to pass in between the notepads of neighboring quadrants, so that the presence of the notepads does not interfere with folding and unfolding of the various major portions of the article about the various folding axes. Also, in the exemplary embodiment of FIG. 4, primary folding axis 10 is a compound folding axis. By this is meant that hinged connection 31 that provides primary folding axis 10, is a compound hinged connection comprised of two parallel hinged sub-connections 31*a* and 31*b*. A vertical spacer strip 33 is provided between sub-connections 31*a* and 31*b*. (Such sub-connections may be provided in the same manner as described elsewhere herein, e.g. by the use of score lines that penetrate partway through the thickness of backing 2). The providing of such a compound folding axis/compound hinged connection with a vertical spacer strip therebetween, may allow article 1 to be folded about folding axis 10 into a second, substantially closed position as shown in FIG. 5. From FIG. 5 it is evident that if the distance between hinged sub-connections 31*a* and 31*b* (i.e., the width of vertical spacer strip 33) is chosen with respect to the combined thickness of notepads (or of any other item) provided on the front side of article 1, article 1 can be closed into a position of the type shown in FIG. 5. In such a position, major vertical portions 11 and 12 of backing 2 may be substantially, or strictly, parallel to each other (in the limiting case of a strictly parallel relationship, a true angle theta may not exist but can be considered to be effectively zero). It will thus be appreciated that a primary folding axis that is a compound folding axis may allow article 1, when in the second, closed position, to take on the appearance and character of a closed book, which may be aesthetically pleasing.

In some embodiments, first, vertical spacer strip 33 may comprise a width between parallel hinged sub-connections 31*a* and 31*b* that is from about 80% to about 150% of the combined thickness of first and second notepads that are mounted on the front side of article 1 and that are brought into a generally face-to-face configuration when article 1 is folded into a second, substantially closed position. It will be appreciated that the front surfaces of two such notepads may contact each other in such a case. It will be appreciated that this is merely one specific case of the general condition that when second, closed position is a substantially closed position, major front surface 41 of front side 40 of first major vertical portion 11 of backing 2, or a component (whether a notepad or some other component) that is mounted on front side 40 of first major vertical portion 11 of backing 2, may come into face-to-face contact with major front surface 41 of front side 40 of second major vertical portion 12 of backing 2 or with a component that is mounted thereon.

In similar manner, secondary folding axis 20 may be a compound folding axis, as shown in FIG. 4. In such case, secondary hinged connection 32 that provides secondary folding axis 20, may be a compound hinged connection that is comprised of two parallel hinged sub-connections 32*a* and 32*b* with a horizontal spacer strip 34 provided therebetween. In such case, when article 1 is folded into the third, popped-up position, it may form a modified A-frame shape, e.g. with horizontal spacer strip 34 forming an apex of the A-frame (which apex may comprise a more flat-topped or truncated appearance than the apex shown in FIG. 3). Thus in various embodiments, either, neither, or both of primary and secondary folding axes 10 and 20 may be a compound folding axis.

Article 1 may comprise (e.g., mounted on first, front side 40 of backing 2) any content, such as e.g. a component, item, indicia, decorative pattern, etc., that it might be desired to present when article 1 is folded into the third, popped-up position. The use of one or more notepads has already been described above. Such a notepad (which can be mounted to front side 40 of backing 2 in any suitable manner) may comprise e.g. a stack of releasably bound paper sheets that are bound to each other at one end so that individual sheets can be removed from the stack. In a specific embodiment, each paper sheet may comprise an area that is backed by adhesive, e.g. repositionable adhesive (as in products available from 3M Company under the trade designation POST-IT® REPOSITIONABLE NOTES). The individual sheets of such a notepad are often of generally similar or identical size to each other, and typically bear a front surface that is a writable surface and a rear surface comprising a strip of adhesive proximate one edge thereof. In some embodiments, the front surface of such sheets may bear preprinted informational indicia (e.g. a business logo, one or more text strings such as e.g. "Shopping List", "From The Desk Of . . . ", and so on); and/or, one or more decorative patterns, images or the like. Thus in broad summary, article 1 may thus be used to display and/or dispense paper notes of any type. Similarly, article 1 may be used to present, display and/or dispense various flags, tabs, markers, etc., as are often used to mark pages, documents and the like.

In a broader sense, article 1 may be used to present, display and/or dispense any item(s) that can be provided in a suitable holder on the front side of article 1. For example, one or more holders (which might be as simple as an envelope or sleeve, or which might be a more complex dispensing container holding e.g. z-folded or fan-folded sheets of paper, flags, etc.) may be mounted on the front side of article 1, e.g. in one of the aforementioned quadrants. Such a holder might contain e.g. business cards, coupons, advertisements, novelty items, and so on, which may be removed from the holder if desired. In various embodiments, such a holder may be opaque, or may be transparent if visibility of the held items is desired. In a particular embodiment, article 1 might contain an actuator such that folding article 1 into a popped-up position causes an item to be partially ejected its holder so as to more easily be displayed or removed. Still further, at least some portion of front side 40 of article 1 may comprise an informational indicia and/or a decorative display rather than presenting an item or items that can be removed therefrom. For example, one or more quadrants of front side 40 of article 1 may have printed upon the front surface 41 thereof, various informational indicia, decorative patterns, and so on.

In a specific embodiment, a first side of an article 1 (e.g., the near side of article 1 as viewed in FIG. 3) might have one or more notepads etc. mounted thereupon, while a second side of an article (e.g., the far surface of major portion 21 of article 1 as viewed in FIG. 3) might have a user's name presented thereon. Such an article might serve e.g. as an identifying placard of the type often used in meetings, classes, seminars, and the like, and so might bear the user's name (and, optionally, the user's affiliation or other information) on the second side so as to be visible by others, and might also bear one or more notepads, business card holders, etc., on the first side. In a particular embodiment, the second side of such an article might comprise one or more holders (e.g., transparent sleeves) into which a placard (e.g., a printed placard bearing the name of the user) might be inserted. Such a holder or holder may of course be configured so as to not interfere with the aforementioned closing of article 1 into the second, closed position.

Any combination of the above-discussed dispensers, informational indicia, decorative patterns, and the like, can of course be used in any desired combination. Article 1 may be configured so that any such dispensable items may be refilled; or, article 1 may be designed to be disposed once such dispensable items are exhausted.

Tensioning member 50 can be made of any material that can be placed and held under tension in the required manner. In some embodiments, such a tensioning member may be made of a material (e.g., certain metals or plastics) that is not inherently elastic but with elasticity being achieved by the mechanical design of the structure (e.g., by forming metal into a coil spring configuration). Thus in some embodiments, tensioning member 50 may be comprised of a spring (e.g., a coil spring) as exemplified in FIG. 1. Such a spring might be made of any suitable plastic or metal (e.g., steel, brass, and so on), with the parameters of the spring (e.g., length, coil pitch, coil diameter, spring constant, and so on), being chosen for the design of a particular article 1.

In other embodiments, tensioning member 50 may be comprised of an intrinsically elastic material such as e.g. an elastomeric polymeric material (e.g., a rubber strip, rubber band, bungee, or the like). Combinations of the two approaches may be used, of course. The tensioning force provided by tensioning member 50 may set as desired e.g. by the choice of the elastomeric material from which member 50 is made, and/or by the design parameters of tensioning member 50 (e.g., diameter of the member, and so on). It may be advantageous that such an elastomeric material be chosen to have a low creep (e.g., so that tensioning member 50 retains the desired tensioning ability even if article 1 is stored for long periods of time with member 50 in a stretched condition (e.g., if article 1 is kept in the second, closed position for extended periods of time)).

Tensioning member 50 may be, but does not necessarily have to be, attached to backing 2 at locations 51 and 52 at which tensioning member 50 is tensionably engaged with backing. All that is necessary is that tensioning member 50 is tensionably engaged with (i.e., is in contact with so as to be able to exert a pulling force on) to backing 2 in those locations so as to be able to promote the folding of backing 2 into a popped-up position. In some embodiments tensioning member 50 (e.g., terminal ends of member 50) may be attached to backing 2 at one or both of engagement locations 51 and 52. Such attachment might be achieved by any suitable attachment mechanism, whether by mechanical attachment (e.g., by one or more staples, rivets, clips, or the like, or by tying, etc.), or by chemical/adhesive attachment (e.g., by use of an adhesive tape, a liquid adhesive, solder, etc.)

Figure 6:
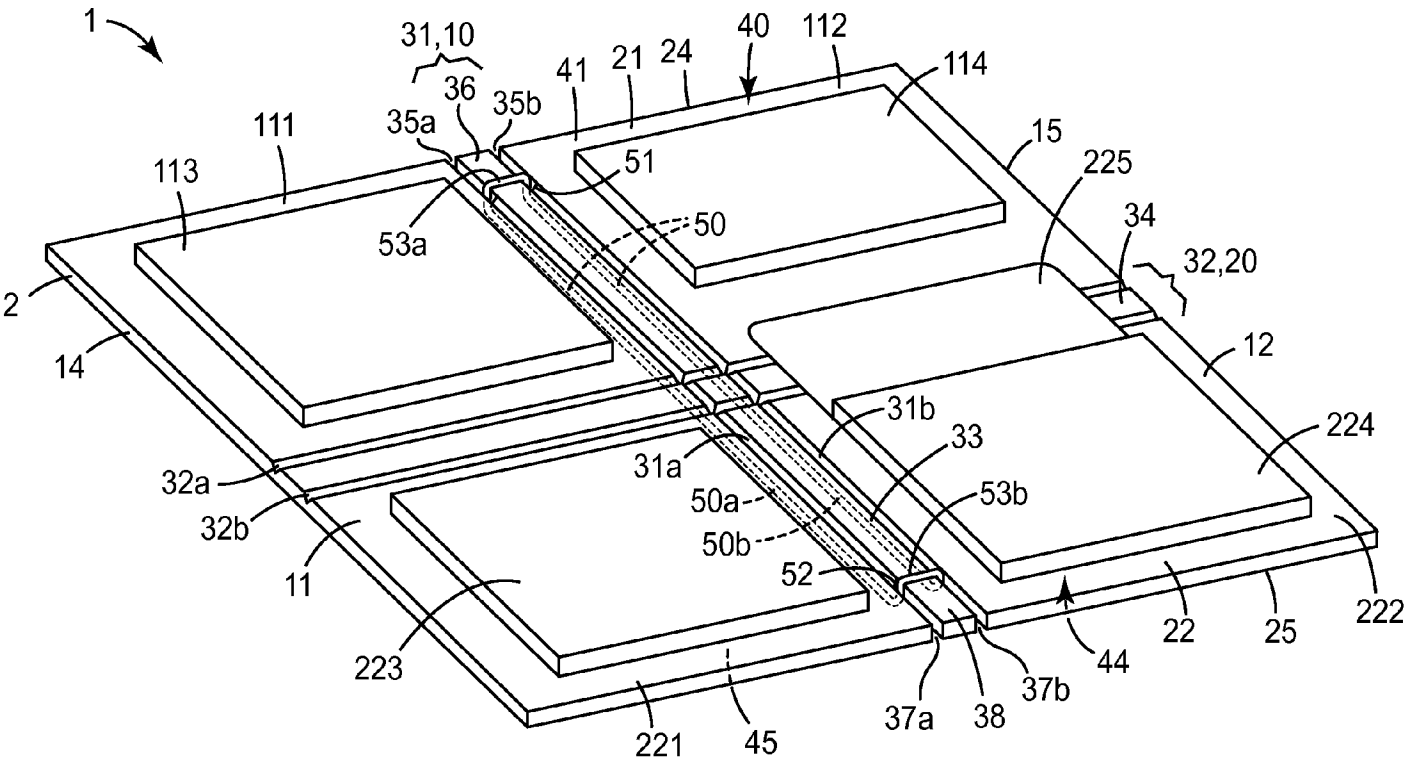
FIG. 6 is a perspective view, from the front side, of another exemplary foldable pop-up article in a first, open position.

An exemplary embodiment in which tensioning member 50 may not necessarily need to be attached (e.g., bonded or mechanically fastened) to backing 2 at locations 51 and 52 is shown in FIG. 6. This example is also one in which tensioning member 50 is provided in the form of a continuous elastic band or loop (e.g., a rubber band type material) that is tensionably engaged with backing 2 at locations 51 and 52 with two (generally parallel) elongated portions of loop 50 extending therebetween (so that, in effect, two separate tensioning members 50*a* and 50*b* are provided). Backing 2 of exemplary article 1 of FIG. 6 is of generally similar overall design to that of FIG. 4, with the modification that notches 35*a* and 35*b* are provided along horizontal edge 24 of backing 2 and extend inward therefrom (e.g., toward the opposite horizontal edge of backing 2), so as to collectively form stanchion 36. Continuous loop tensioning member 50 can be extended along the rearward side of backing 2 as shown in FIG. 6, and portion 53*a* of loop member 50 can be passed forwardly through notches 35*a* and 35*b* so that portion 53*a* of tensioning loop 50 is positioned on the frontward side of backing 2 e.g. in a location generally proximal to first horizontal edge 24. Portion 53*b* of loop member 50 can similarly be passed through notches 37*a* and 37*b* and positioned on the frontward side of backing 2 e.g. in a location generally proximal to second horizontal edge 25. (In the illustrated embodiment, notches 35*a* and 37*a* are shown as aligned with hinged connection 31*a*; likewise notches 35*b* and 37*b* are shown as aligned with hinged connection 31*b*. However, such notches do not necessarily have to be aligned with a hinged connection.)

Thus, in this manner continuous loop tensioning member 50 can be mounted on backing 2, with member 50 tensionably engaging backing 2 at locations 51 and 52 (which locations may be defined e.g. by the terminal, closed ends of the notches). Moreover, this may be done without any attachment mechanism (e.g., adhesive or mechanical attachment) necessarily being used to attach member 50 to backing 2, whether at locations 51 and 52 or anywhere along the extent of member 50. In other words, in some embodiments tensioning member 50 may be held in position on backing 2 by the contractive force of the tensioning member itself; however, an attachment mechanism may be used to augment this if desired. It will be appreciated that any suitable design of such notches, stanchions, etc., may be used; also, it will be appreciated that such features may be used with one or more tensioning members that are not continuous loops. And, in some embodiments, a tensioning member 50 may not necessarily be a continuous loop but may rather comprise a linear segment with a loop at each end thereof, each loop being designed e.g. to fit over a stanchion that is located proximal a horizontal edge of the backing. In still other embodiments, a tensioning member may be an elastic member an end of which is wrapped around an edge (e.g., edge 24 or 25) of backing 2 and then attached to the front side of the backing, with the location at which the member wraps around the edge thus forming an engaging location without the member necessarily being attached to the backing at that location.

In various embodiments, some or all of the elongate length of a tensioning member 50 may be contained within a cover or sleeve (which may serve a function that is protective, decorative, or both). If desired, a tensioning member 50 (e.g., one or both ends thereof, if such ends exist; or, a portion of a continuous loop member) may be removably engaged with (e.g., attached to) backing 2 so as to be removable from, and/or re-engagable with, backing 2 as desired. In specific embodiments multiple engagement locations and/or attachment points may be provided so that the tensioning of member 50 (i.e., the amount to which it is stretched when article 1 is placed in the first, open position) may be altered as desired. In some embodiments, no portion of tensioning member that lies between engagement locations 51 and 52 is attached to backing 2.

As mentioned earlier, a foldable and unfoldable pop-up article 1 as disclosed herein comprises at least a primary folding axis, and further comprises at least one secondary folding axis that is oriented at an angle that is at least about 30 degrees away from the primary folding axis. The above-discussed illustrative embodiment of FIGS. 1-6 depicts a general type of article 1 comprising a primary folding axis 10 and a single secondary folding axis 20 that is oriented at least generally orthogonally to primary folding axis 10.

Figure 7:
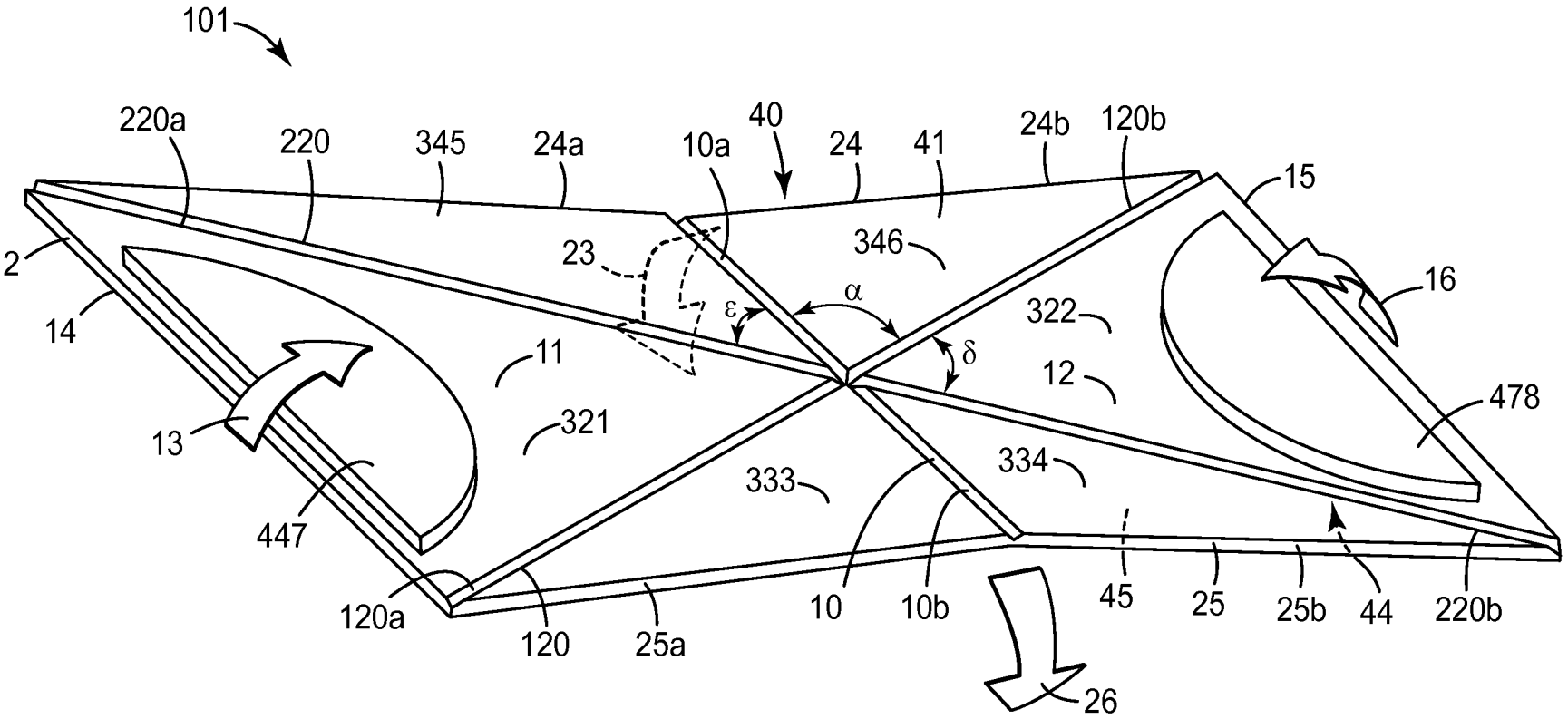
FIG. 7 is a perspective view, from the front side, of another exemplary foldable pop-up article in a first, open position.

FIG. 7 depicts in exemplary embodiment another general type of a foldable and unfoldable pop-up article 101 (in perspective view, from the front side, with the article in a first, open position). A tensioning member 50 is omitted from FIG. 7 for ease of presentation of other components and relationships, but it will be understood that any of the above-described tensioning members (e.g. member 50 of FIG. 1, or member 50 of FIG. 6, similarly positioned as in those Figures) could be used. Article 101 of FIG. 7 comprises a primary folding axis 10, and further comprises two (i.e., first and second) secondary folding axes 120 and 220. In various embodiments, the (included) angle between first secondary folding axis 120 and primary folding axis 10 (e.g. angle gamma (γ) of FIG. 7) may be at least about 30, 40, or 50 degrees. In further embodiments, this angle may be at most about 80, 70 or 60 degrees. In various embodiments, the angle between second secondary folding axis 220 and primary folding axis 10 (e.g. angle epsilon (ϵ) of FIG. 7) may likewise be at least about 30, 40, and 50, degrees, and at most about 80, 70 or 60 degrees. In various embodiments, the included angle between the first and second secondary folding axes (e.g. angle delta (δ) of FIG. 7) may be at least about 30, 40 or 50 degrees. In further embodiments, the angle between the first and second secondary folding axes may be at most about 90, 80, or 70 degrees. First and second secondary folding axes 120 and 220 may be, but do not necessarily have to be, present in a symmetrical pattern (i.e., with angles gamma and epsilon being similar or equal to each other and/or with axes 120 and 220 intersecting each other at a common intersection with primary folding axis 10, e.g. as depicted in the exemplary embodiment of FIG. 7). First and second secondary folding axes may, but do not necessarily have to, terminate in corners of backing 2 of article 1 (as in FIG. 7).

Article 101 of FIG. 7 can be folded about primary folding axis 10 into a second, closed position, in generally similar manner as described previously herein (in which closed position it may comprise a shape similar an isosceles trapezoid). However, exemplary article 101 may comprise several differences from exemplary article 1 which may be most evident when article 101 is in the third, popped-up position. For example, first secondary folding axis 120 of article 101 may comprise two linear segments 120*a* and 120*b* that, when article 101 is in the third, popped-up position, are not co-linear with each other, but rather meet at an angle (e.g. at their intersection with primary folding axis 10). The same holds true for segments 220*a* and 220*b* of second secondary folding axis 220. (This may be contrasted with secondary folding axis 20 of article 1 of FIG. 1, which folding axis may remain generally linear along its entire extent when the article is in the third, popped-up position.)

Moreover, at least in some embodiments, horizontal edges 24 and 25 of article 101 may each comprise two segments (e.g., 24*a* and 24*b*, and 25*a* and 25*b*) that are each generally linear and that meet at or near primary folding axis 10, in similar manner to the corresponding horizontal edges of article 1. However, in article 101, the two segments of each horizontal edge are angled with respect to each other so that article 101 (when in the first position) comprises a generally "bow-tie" shape as seen in FIG. 7 (i.e., rather than the rectangular shape of article 1 in FIG. 1). It will be appreciated that with this type of design, folding article 1 about first and second secondary folding axes 120 and 220 (so as to put article 101 into the third, popped-up position) will draw the centermost portion of horizontal edge 24 and the centermost portion of horizontal edge 25 closer together to each other, while leaving the outermost portions of these horizontal edges (i.e., those portions proximal to vertical edges 14 and 15) less drawn together. Furthermore, when article 101 of FIG. 7 is folded into the third, popped-up position, the two major vertical edges 14 and 15 may not necessarily be placed into an A-frame configuration as happens with article 1 of FIG. 1. Rather, major edges 14 and 15 of article 101 may each remain generally, or strictly, linear. Thus, folding article 101 into a third, popped-up position may result in the preferential drawing-together of the horizontally centermost portions of edges 24 and 25 of the article (e.g., along a direction generally parallel to primary folding axis 10), causing the article to assume a more pronounced bow-tie shape (e.g. when viewed from above front side 40 of the article).

Still further, when in the third, popped-up position, article 101 may present two major front-side faces 321 and 322, each of which may be generally triangular in shape and which may face generally along the length dimension of article 101 (that is, such faces may comprise a normal axis that is oriented generally parallel to the length dimension of article 101 when viewed from above). This arrangement may be contrasted to the embodiment of FIGS. 1-3, in which no such length-dimension-facing faces, of any shape, are present when article 1 is in the third, popped-up position. When in the third, popped-up position, article 101 may also comprise first and second minor faces 333 and 334 (the first being defined by folding axis segments 10*b* and 120*a*, and edge segment 25*a*; the second being defined by folding axis segments 10*b* and 220*b*, and edge segment 25*b*). Likewise, article 101 may comprise third and fourth minor faces 345 and 346, the first being defined by folding axis segments 10*a* and 220*a*, and edge segment 24*a*; the second being defined by folding axis segments 10*a* and 120*b*, and edge segment 24*b*. All of these minor faces may be generally triangular in shape and may, but do not have to be, generally similar in shape and/or size with each other.

It is thus evident that several differences exist between the illustrative embodiments exemplified by the depicted articles 1 and 101. However, it will be understood that any of the features and components previously described with respect to article 1, can be present in the embodiment exemplified by article 101. In particular, any of the faces of article 101, (e.g., major faces 321 and/or 322) may comprise any desired item mounted thereon. In the exemplary embodiment illustrated shown in FIG. 7, faces 321 and 322 each comprise a notepad stack (numbered 447 and 478 respectively) which may optionally be shaped so as to optimally fit within area 321 or 322, e.g. as shown in FIG. 7.

A foldable and unfoldable pop-up article as disclosed herein may be of any suitable size. For example, such an article may be of nominal 25 cm×15 cm size when in the first, open position. With respect to exemplary article 1, primary folding axis 10 and/or secondary folding axis 20 may fall, but do not necessarily have to fall, on an axis of symmetry of article 1 when it is in the first, open position. Such an article may or may not be configured so that vertical portions 11 and 12 can be rotated about primary folding axis 10, from the first, open position, in a retrograde direction away from the second, closed position (that is, in a direction opposite that indicated by arrows 13 and 16 of FIG. 1). Similarly (with respect to article 1), such an article may or may not be configured to prevent retrograde rotation of horizontal portions 21 and 22 about secondary folding axis 20 past the first, open position in a direction away from the third, popped-up position. Still further, if desired a stop feature may be provided in article 1 to limit the rotation of the horizontal portions 21 and 22 about secondary folding axis 20 toward the third, popped-up position (as motivated by tensioning member 50) to a desired angle. Any of these features may likewise be provided on article 101 with respect to rotation about primary folding axis 10 and/or first and second secondary folding axes 120 and 220.

If desired, such an article may comprise a locking mechanism (exemplified by snap/strap 17 and socket 18 of FIG. 1) that may secure the article in the second, generally closed position. An analogous locking mechanism (not shown in any Figure) may likewise be used to secure the article in the third, popped-up position if desired. Rear surface 44 of backing 2 may be a decorative surface, which may comprise any desired solid color, decorative pattern or patterns, informational indicia, or combination thereof. In some embodiments, rear surface 44 may be provided by a cover (e.g., a vinyl, cloth or leather cover of the type often used on books and the like) that may at least partially wrap around onto at least an edge (perimeter) portion of front surface 41. As provided by a wrap-around cover or in any other manner, front surface 41 (e.g., at least areas thereof that are not obscured by items mounted to front side 40 of article 1) may thus bear any desired decorative pattern, informational indicia, etc.

If desired, horizontal edges 24 and 25 (upon which the article may be supported when in the third, popped-up position) may comprise any suitable treatment, coating or the like, which may increase the frictional interaction of edges 24 and 25 with a gravitationally-horizontal surface 27 and thus which may enhance the stability of the article when resting upon such a surface in the third, popped-up position. If desired, such a treatment might comprise a directionally-oriented treatment which might preferentially allow the motion of edges 24 and 25 across such a surface in a direction toward the third, popped-up position, but which might preferentially resist the motion of edges 24 and 25 across such a surface in an opposite direction. In some embodiments major portions of horizontal edges 24 and 25, and/or of vertical edges 14 and 15, may be strictly linear (except as interrupted e.g. by notches which, as discussed earlier, may serve e.g. to accept and seat portions of a tensioning member). In other embodiments, any or all of such edges may comprise non-linear (e.g., scalloped, arcuate, etc.) portions.

In some embodiments, a foldable and unfoldable pop-up article as disclosed herein may comprise a "signpost" item exemplified by component 225 of FIG. 6. When the article is in the first, open position, such a signpost item may extend across a single secondary folding axis (e.g., axis 20 of FIG. 6); or, if multiple secondary folding axes are present, such an item may extend across one or both of the secondary folding axes. When the article is folded into the third, popped-up position, such a signpost item may extend generally upward (e.g., with respect to article 1 of FIG. 6, it may extend upward past folding axis 20, which forms the apex of the A-frame shape of the popped-up article and which might otherwise provide the upwardmost portion of the popped-up article). Such an item might be e.g. a tab or flap (as exemplified by item 225 of FIG. 6, of any suitable shape or form); might be, or might contain, one or more removable items; might be a notepad, and so on, as desired. Such a signpost item might bear any suitable informational indicia, decorative pattern, and so on. It will be appreciated that in some cases, the dimension of such a signpost item or items across a portion of the backing upon which the signpost item is mounted (from a horizontal edge of the backing to a secondary folding axis of the backing), may be greater than the distance from the horizontal edge of the backing to the secondary folding axis of the backing, without necessitating that the item be folded during storage or use of the article (e.g., as with item 225 of FIG. 6).

LIST OF EXEMPLARY EMBODIMENTS

Embodiment 1. A foldable and unfoldable pop-up article, comprising: a backing with a width and a length and with a primary folding axis that extends the width of the backing and with at least one secondary folding axis that is oriented at an angle that is at least about 30 degrees away from the primary folding axis and that extends the length of the backing; and, a tensioning member with a long axis that is oriented at least 30 degrees away from the at least one secondary folding axis and that is tensionably engaged with the backing at first and second engagement locations of the backing.

Embodiment 2. The article of embodiment 1 wherein the at least one secondary folding axis is a single secondary folding axis that is oriented within plus or minus 5 degrees of orthogonal to the primary folding axis and wherein the long axis of the tensioning member is oriented within plus or minus 5 degrees of orthogonal to the single secondary folding axis.

Embodiment 3. The article of any of embodiments 1-2 wherein the primary folding axis comprises at least one primary hinged connection that divides the backing into first and second major vertical portions that are hingedly connected to each other so as to be rotatable relative to each other about the primary folding axis, and wherein the secondary folding axis comprises at least one secondary hinged connection that divides the backing into at least first and second major horizontal portions that are hingedly connected to each other so as to be rotatable relative to each other about the secondary folding axis.

Embodiment 4. The article of any of embodiments 1-3 wherein the backing comprises first, second, third and fourth major quadrants, wherein the first and second quadrants are vertically-neighboring quadrants that combine to provide the first major vertical portion, the third and fourth quadrants are vertically-neighboring quadrants that combine to provide the second major vertical portion, the first and third quadrants are horizontally-neighboring quadrants that combine to provide the first major horizontal portion, and the second and fourth quadrants are horizontally-neighboring quadrants that combine to provide the second major horizontal portion, and wherein each quadrant is generally planar and made of a rigid material and is hingedly connected to its neighboring quadrants.

Embodiment 5. The article of embodiment 4 wherein at least one of a notepad, a dispensing device, a decorative pattern, or an informational indicia, is provided on a front side of at least one of the first, second, third and fourth major quadrants of the backing.

Embodiment 6. The article of any of embodiments 4-5 wherein a notepad is mounted on a front side of each of the first, second, third and fourth major quadrants of the backing, and wherein the primary and secondary folding axes each comprise at least one hinged connection that passes in between notepads of neighboring quadrants.

Embodiment 7. The article of any of embodiments 3-6 wherein the first and second major vertical portions are substantially equal to each other in size, and wherein the first and second major horizontal portions are substantially equal to each other in size.

Embodiment 8. The article of any of embodiments 3-7 wherein the article is foldable about the primary folding axis from a first, open position in which the first and second major vertical portions of the backing, and the first and second major horizontal portions of the backing, are all generally coplanar with each other, into a second, generally closed position in which the first and second major vertical portions of the backing form an included angle with each other of from about 130 degrees to about 0 degrees.

Embodiment 9. The article of embodiment 8 wherein the second position is a substantially closed position in which the included angle is from about 20 to about 0 degrees and in which a major front surface of a front side of the first major vertical portion of the backing, or a component that is mounted on the front side of the first major vertical portion of the backing, is in face-to-face contact with a major front surface of a front side of the second major vertical portion of the backing or with a component that is mounted on the front side of the second major vertical portion of the backing.

Embodiment 10. The article of any of embodiments 8-9 wherein the article is foldable about the secondary folding axis from a first, open position in which the first and second major vertical portions of the backing, and the first and second major horizontal portions of the backing, are all generally coplanar with each other, into a third, popped-up position in which the first and second major horizontal portions form an included angle with each other of from about 130 degrees to about 30 degrees.

Embodiment 11. The article of embodiment 10 wherein when the article is in the second, generally closed position, a major front surface of the first major vertical portion of the backing is in generally facing relation with a major front surface of the second major vertical portion of the backing, and wherein when the article is in the third, popped-up position, a major rear surface of the first major horizontal portion of the backing is in generally facing relation with a major rear surface of the second major horizontal portion of the backing.

Embodiment 12. The article of any of embodiments 3-11 wherein the article is foldable about the secondary folding axis from a first, open position in which the first and second major vertical portions of the backing, and the first and second major horizontal portions of the backing, are all generally coplanar with each other, into a third, popped-up position in which the first and second major horizontal portions form an included angle with each other of from about 130 degrees to about 30 degrees.

Embodiment 13. The article of any of embodiments 3-12 wherein the first major horizontal portion comprises a first horizontal edge and wherein the second major horizontal portion comprises a second horizontal edge, and wherein the article is configured so that when the article is in a third, popped-up position the article can rest upon a gravitationally-horizontal surface with the first and second horizontal edges in contact with the surface and with the secondary folding axis comprising the gravitationally-uppermost portion of the article, with the tensioning member being tensioned sufficiently to prevent the article from unfolding into the first, open position under the force of gravity.

Embodiment 14. The article of any of embodiments 1-13 wherein the tensioning member is tensioned sufficiently so as to bias the article toward a third, popped-up position with sufficient force that when the article is in a first, open position, the article will spontaneously fold into the third, popped-up position unless an outside force is exerted on the article to prevent it from folding into the third position.

Embodiment 15. The article of any of embodiments 3-14 wherein the primary folding axis is a compound folding axis configured so that the primary hinged connection is a compound hinged connection comprising two parallel hinged sub-connections with a first, vertical spacer strip between the two parallel hinged sub-connections.

Embodiment 16. The article of embodiment 15 wherein the backing comprises rigid paperboard with a thickness and wherein the two parallel hinged sub-connections are provided by parallel score lines that extend along the rigid paper board and that penetrate partway through the thickness of the rigid paperboard.

Embodiment 17. The article of any of embodiments 15-16 wherein the article comprises a first notepad that is mounted on a front side of the first major vertical portion of the backing, and a second notepad that is mounted on a front side of the second major vertical portion of the backing, and wherein the article is configured so that the first and second notepads meet each other in a substantially face-to-face configuration when the article is in a second, substantially closed position, and wherein the first, vertical spacer strip comprises a width between the two parallel hinged sub-connections that is from about 80% to about 150% of a combined thickness of the first and second notepads, such that when the article is in the second, substantially closed position with the first and second notepads in the substantially face-to-face configuration, the first and second major vertical portions of the backing are substantially parallel to each other.

Embodiment 18. The article of any of embodiments 15-17 wherein the secondary folding axis is a secondary compound folding axis configured so that the secondary hinged connection is a secondary compound hinged connection comprising two parallel hinged sub-connections comprising a second, horizontal spacer strip between them.

Embodiment 19. The article of any of embodiments 3-18 wherein the secondary folding axis is a secondary compound folding axis comprising a secondary compound hinged connection comprising two parallel hinged sub-connections comprising a secondary horizontal spacer strip between the two parallel hinged sub-connections.

Embodiment 20. The article of any of embodiments 1-19 wherein the backing comprises rigid paperboard with a thickness and wherein the primary folding axis comprises a first hinged connection provided by at least one score line that extends along at least a portion of the width of the rigid paper board and that penetrates partway through the thickness of the rigid paperboard, and wherein the at least one secondary folding axis comprises a secondary hinged connection provided by at least one score line that extends along at least a portion of the width of the rigid paper board and that penetrates partway through the thickness of the rigid paperboard.

Embodiment 21. The article of any of embodiments 1-20 wherein the tensioning member is substantially aligned with the primary folding axis and wherein the long axis of the tensioning member is oriented within plus or minus 10 degrees of parallel to the primary folding axis.

Embodiment 22. The article of any of embodiments 1, 3, 8, 9, and 14-21 wherein the at least one secondary folding axis comprises first and second secondary folding axes that are each oriented about 50-70 degrees away from the primary folding axis and that are oriented about 50-70 degrees away from each other.

Embodiment 23. The article of embodiment 22 wherein the first and second secondary folding axes intersect at a point that is proximate the primary folding axis, and wherein the long axis of the tensioning member is oriented at least generally parallel to the primary folding axis.

Embodiment 24. The article of any of embodiments 22-23 wherein the long axis of the tensioning member is oriented parallel to the primary folding axis and is aligned with the primary folding axis.

Embodiment 25. The article of any of embodiments 1-24 wherein the tensioning member is a continuous loop tensioning member.

WORKING EXAMPLES

Representative Working Example

A product was obtained from 3M Company, St. Paul, Minn. under the trade designation POST-IT 4"×6" Flower Burst Hard Cover Book. The product resembled a conventional hard-cover book (of size approximately 25 cm×16.5 cm inches when fully opened, and approximately 16.5 cm×11.5 cm when fully closed). The cover of the book was a rigid paperboard backing of thickness approximately 2 mm, with a decorative flower pattern on the outside of the cover. First and second parallel hinged sub-connections (of the general type exemplified by hinged sub-connections 31*a* and 31*b* of FIG. 4, except that they penetrated into the rigid paperboard from both sides) were present in the product as obtained. The first and second hinged sub-connections were spaced at a distance of approximately 16 mm apart with a spacer strip therebetween, which formed the spine of the book.

As received, the product contained a single notepad (of nominal dimension 10 cm×15 cm, and of nominal thickness 11 mm) attached to the inside of one leaf of the cover. The single notepad was detached from the product and removed. Four notepads (obtained from 3M Company under the trade designation POST-IT) were obtained, each comprising a stack of paper sheets of total thickness about 5 mm and each measuring approximately 10 cm×7.5 cm. The four notepads were attached to the inside cover of the book (two on each leaf), with the short axis of each notepad being aligned with the first and hinged sub-connections. A gap of about 8 mm was left between each hinged sub-connection and the closest terminal edge of a notepad. A gap of about 14 mm was left between the upper and lower notepads of each leaf.

Two parallel score lines, as formed by cutting through approximately 90% of the thickness of the rigid paperboard backing (cover) with a blade, were formed in the rigid paperboard backing, extending from one major edge of the backing to the other major edge, in a direction approximately orthogonal to the existing hinged sub-connections and passing between the upper and lower pairs of notepads. The score lines were approximately 13 mm apart and served to provide hinged sub-connections of a secondary folding axis of the finished article, akin to hinged sub-connections 32*a* and 32*b* of FIG. 4. (The above-mentioned first and second hinged sub-connections served to provide a primary folding axis of the finished article.)

A metal spring was obtained, of coil diameter approximately 2 mm and of a resting (untensioned) length estimated to be in the range of approximately 3-4 inches. Each end of the spring was attached to a straight metal cotter of length approximately 15 mm and of diameter approximately 1.5 mm. A first hole, of diameter approximately 3 mm, was drilled through the backing (cover), in the spine of the book (between the aforementioned first and second hinged sub-connections), approximately 7 mm from the edge of the cover. A second, corresponding hole was drilled at the other end of the spine of the book. The metal cotters were then passed endwise through the holes and rotated so that they could not pass back therethrough, so as to secure the coil spring to the cover, with the spring being on the rear side of the cover (i.e., on the side opposite the four notepads).

Thus in this manner, a finished article was produced that was generally similar to that shown in FIG. 4 (except that FIG. 4 does not show the tensioning member or the hole/cotter method of attaching the member to the backing that was used in the Representative Working Example). The finished article could be carried, stored, etc., while in the second, closed position (that is, in a book format). When desired, it could be opened (i.e., unfolded about the primary folding axis) into a flat, first position. Upon this being done (with the article e.g. lying on a surface such as a desktop), the article would, under the motivating force of the spring, spontaneously fold about the secondary folding axis into a popped-up position of the general type shown in FIG. 3. The spring served to maintain the article in this popped-up position (that is, the article did not collapse back into the first, open position under the influence of gravity).

Other Working Examples

Numerous other Working Examples were also produced. In some cases, the thus-produced article comprised a continuous loop tensioning member arranged in the general manner depicted in FIG. 6. In some cases, the article comprised a bow-tie design of the general type depicted in FIG. 7. In some cases, two springs were arranged in series and connected end-to-end to collectively provide a suitable tensioning member. In some cases, the article comprised a rearwardly-protruding bump on the spine of the article, which served to further promote the spontaneous folding of the article into the third, popped-up position when the article was placed on a surface in the first, open position. In some cases, the article comprised a non-rigid backing rather than a the above-described rigid backing (that is, the article was more akin to a soft-cover, paperback book or pamphlet than to a hard-cover book).

The tests and test results described above are intended solely to be illustrative, rather than predictive, and variations in the testing procedure can be expected to yield different results. All quantitative values in the Examples section are understood to be approximate in view of the commonly known tolerances involved in the procedures used. The foregoing detailed description and examples have been given for clarity of understanding only. No unnecessary limitations are to be understood therefrom.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention not merely those representative designs that were chosen to serve as exemplary illustrations. Thus, the scope of the present invention should not be limited to the specific illustrative structures described herein, but rather extends at least to the structures described by the language of the claims, and the equivalents of those structures. To the extent that there is a conflict or discrepancy between this specification as written and the disclosure in any document incorporated by reference herein, this specification as written will control.

What is claimed is:

1. A foldable and unfoldable pop-up article, comprising:

a backing with a width and a length and with a primary folding axis that extends the width of the backing and with at least one secondary folding axis that is oriented at an angle that is at least about 30 degrees away from the primary folding axis and that extends the length of the backing;

and, at least one tensioning member with a long axis that is oriented at least 30 degrees away from the at least one secondary folding axis and that is tensionably engaged with the backing at first and second engagement locations of the backing, wherein the at least one secondary folding axis is a single secondary folding axis that is oriented within plus or minus 5 degrees of orthogonal to the primary folding axis and wherein the long axis of the tensioning member is oriented within plus or minus 5 degrees of orthogonal to the single secondary folding axis, wherein the primary folding axis comprises at least one primary hinged connection that divides the backing into first and second major vertical portions that are hingedly connected to each other so as to be rotatable relative to each other about the primary folding axis, and wherein the secondary folding axis comprises a secondary hinged connection that divides the backing into first and second major horizontal portions that are hingedly connected to each other so as to be rotatable relative to each other about the secondary folding axis, wherein the article is foldable about the secondary folding axis from a first, open position in which the first and second major vertical portions of the backing, and the first and second major horizontal portions of the backing, are all generally coplanar with each other, into a third, popped-up position in which the first and second major horizontal portions form an included angle with each other of from about 130 degrees to about 30 degrees, and, wherein the first major horizontal portion comprises a first horizontal edge and wherein the second major horizontal portion comprises a second horizontal edge, and wherein the article is configured so that when the article is in the third, popped-up position the article can rest upon a gravitationally-horizontal surface with the first and second horizontal edges in contact with the surface and with the secondary folding axis comprising the gravitationally-uppermost portion of the article, with the tensioning member being tensioned sufficiently to prevent the article from unfolding into the first, open position under the force of gravity.

2. The article of claim 1 wherein the backing comprises first, second, third and fourth major quadrants, wherein the first and second quadrants are vertically-neighboring quadrants that combine to provide the first major vertical portion, the third and fourth quadrants are vertically-neighboring quadrants that combine to provide the second major vertical portion, the first and third quadrants are horizontally-neighboring quadrants that combine to provide the first major horizontal portion, and the second and fourth quadrants are horizontally-neighboring quadrants that combine to provide the second major horizontal portion, and wherein each quadrant is generally planar and made of a rigid material and is hingedly connected to its neighboring quadrants.

3. The article of claim 2 wherein at least one of a notepad, a dispensing device, a decorative pattern, or an informational indicia, is provided on a front side of at least one of the first, second, third and fourth major quadrants of the backing.

4. The article of claim 3 wherein a notepad is mounted on a front side of each of the first, second, third and fourth major quadrants of the backing, and wherein the primary and secondary folding axes each comprise at least one hinged connection that passes in between notepads of neighboring quadrants.

5. The article of claim 1 wherein the first and second major vertical portions are substantially equal to each other in size, and wherein the first and second major horizontal portions are substantially equal to each other in size.

6. The article of claim 1 wherein the article is foldable about the primary folding axis from a first, open position in which the first and second major vertical portions of the backing, and the first and second major horizontal portions of the backing, are all generally coplanar with each other, into a second, generally closed position in which the first and second major vertical portions of the backing form an included angle with each other of from about 130 degrees to about 0 degrees.

7. The article of claim 6 wherein the second position is a substantially closed position in which the included angle is from about 20 to about 0 degrees and in which a major front surface of a front side of the first major vertical portion of the backing, or a component that is mounted on the front side of the first major vertical portion of the backing, is in face-to-face contact with a major front surface of a front side of the second major vertical portion of the backing or with a component that is mounted on the front side of the second major vertical portion of the backing.

8. The article of claim 6 wherein the article is foldable about the secondary folding axis from a first, open position in which the first and second major vertical portions of the backing, and the first and second major horizontal portions of the backing, are all generally coplanar with each other, into a third, popped-up position in which the first and second major horizontal portions form an included angle with each other of from about 130 degrees to about 30 degrees.

9. The article of claim 8 wherein when the article is in the second, generally closed position, a major front surface of the first major vertical portion of the backing is in generally facing relation with a major front surface of the second major vertical portion of the backing, and wherein when the article is in the third, popped-up position, a major rear surface of the first major horizontal portion of the backing is in generally facing relation with a major rear surface of the second major horizontal portion of the backing.

10. The article of claim 1 wherein the backing comprises rigid paperboard with a thickness and wherein the primary folding axis comprises a first hinged connection provided by at least one score line that extends along at least a portion of the width of the rigid paper board and that penetrates partway through the thickness of the rigid paperboard, and wherein the at least one secondary folding axis comprises a secondary hinged connection provided by at least one score line that extends along at least a portion of the width of the rigid paper board and that penetrates partway through the thickness of the rigid paperboard.

11. The article of claim 1 wherein the tensioning member is substantially aligned with the primary folding axis and wherein the long axis of the tensioning member is oriented within plus or minus 10 degrees of parallel to the primary folding axis.

12. A foldable and unfoldable pop-up article, comprising:

a backing with a width and a length and with a primary folding axis that extends the width of the backing and with at least one secondary folding axis that is oriented at an angle that is at least about 30 degrees away from the primary folding axis and that extends the length of the backing;

and, at least one tensioning member with a long axis that is oriented at least 30 degrees away from the at least one secondary folding axis and that is tensionably engaged with the backing at first and second engagement locations of the backing;

wherein the at least one secondary folding axis is a single secondary folding axis that is oriented within plus or minus 5 degrees of orthogonal to the primary folding axis and wherein the long axis of the tensioning member is oriented within plus or minus 5 degrees of orthogonal to the single secondary folding axis, wherein the primary folding axis comprises at least one primary hinged connection that divides the backing into first and second major vertical portions that are hingedly connected to each other so as to be rotatable relative to each other about the primary folding axis, and wherein the secondary folding axis comprises a secondary hinged connection that divides the backing into first and second major horizontal portions that are hingedly connected to each other so as to be rotatable relative to each other about the secondary folding axis, wherein the article is foldable about the secondary folding axis from a first, open position in which the first and second major vertical portions of the backing, and the first and second major horizontal portions of the backing, are all generally coplanar with each other, into a third, popped-up position in which the first and second major horizontal portions form an included angle with each other of from about 130 degrees to about 30 degrees, and, wherein the tensioning member is tensioned sufficiently so as to bias the article toward the third, popped-up position with sufficient force that when the article is in the first, open position, the article will spontaneously fold into the third, popped-up position unless an outside force is exerted on the article to prevent it from folding into the third position.

13. The article of claim 12 wherein the backing comprises first, second, third and fourth major quadrants, wherein the first and second quadrants are vertically-neighboring quadrants that combine to provide the first major vertical portion, the third and fourth quadrants are vertically-neighboring quadrants that combine to provide the second major vertical portion, the first and third quadrants are horizontally-neighboring quadrants that combine to provide the first major horizontal portion, and the second and fourth quadrants are horizontally-neighboring quadrants that combine to provide the second major horizontal portion, and wherein each quadrant is generally planar and made of a rigid material and is hingedly connected to its neighboring quadrants.

14. The article of claim 13 wherein at least one of a notepad, a dispensing device, a decorative pattern, or an informational indicia, is provided on a front side of at least one of the first, second, third and fourth major quadrants of the backing.

15. The article of claim 14 wherein a notepad is mounted on a front side of each of the first, second, third and fourth major quadrants of the backing, and wherein the primary and secondary folding axes each comprise at least one hinged connection that passes in between notepads of neighboring quadrants.

16. The article of claim 12 wherein the first and second major vertical portions are substantially equal to each other in size, and wherein the first and second major horizontal portions are substantially equal to each other in size.

17. The article of claim 12 wherein the article is foldable about the primary folding axis from a first, open position in which the first and second major vertical portions of the backing, and the first and second major horizontal portions of the backing, are all generally coplanar with each other, into a second, generally closed position in which the first and second major vertical portions of the backing form an included angle with each other of from about 130 degrees to about 0 degrees.

18. The article of claim 17 wherein the second position is a substantially closed position in which the included angle is from about 20 to about 0 degrees and in which a major front surface of a front side of the first major vertical portion of the backing, or a component that is mounted on the front side of the first major vertical portion of the backing, is in face-to-face contact with a major front surface of a front side of the second major vertical portion of the backing or with a component that is mounted on the front side of the second major vertical portion of the backing.

19. The article of claim 17 wherein the article is foldable about the secondary folding axis from a first, open position in which the first and second major vertical portions of the backing, and the first and second major horizontal portions of the backing, are all generally coplanar with each other, into a third, popped-up position in which the first and second major horizontal portions form an included angle with each other of from about 130 degrees to about 30 degrees.

20. The article of claim 19 wherein when the article is in the second, generally closed position, a major front surface of the first major vertical portion of the backing is in generally facing relation with a major front surface of the second major vertical portion of the backing, and wherein when the article is in the third, popped-up position, a major rear surface of the first major horizontal portion of the backing is in generally facing relation with a major rear surface of the second major horizontal portion of the backing.

* * * * *

UNITED STATES PATENT AND TRADEMARK OFFICE

CERTIFICATE OF CORRECTION

PATENT NO. : 8,985,633 B2
APPLICATION NO. : 13/545121
DATED : March 24, 2015
INVENTOR(S) : Douglas Bodziak It is certified that error appears in the above-identified patent and that said Letters Patent is hereby corrected as shown below:

Title Page, Column 2, References Cited (Other Publications)
Line 3-4, Delete "dcscription" and insert -- description --, therefor.

In the Specification
Column 11
Line 20, Delete "re-engagable" and insert -- re-engageable --, therefor.

Column 18
Line 62, Delete "a the" and insert -- the --, therefor.

Signed and Sealed this
Twenty-second Day of September, 2015

Michelle K. Lee

Michelle K. Lee
*Director of the United States Patent and Trademark Office*